US006761623B1

(12) United States Patent
Baker

(10) Patent No.: US 6,761,623 B1
(45) Date of Patent: Jul. 13, 2004

(54) APPARATUS AND METHOD FOR SHARPENING BLADES AT A PREDETERMINED ANGLE

(76) Inventor: Wayne E. Baker, 3904 McVay St., SW., Huntsville, AL (US) 35805

( * ) Notice: Subject to any disclaimer, the term of this patent is extended or adjusted under 35 U.S.C. 154(b) by 0 days.

(21) Appl. No.: 10/408,333

(22) Filed: Apr. 7, 2003

(51) Int. Cl.[7] ..... B24B 7/00
(52) U.S. Cl. ..... 451/280; 451/174
(58) Field of Search ..... 451/280, 45, 47, 451/139, 147, 156, 174, 310, 141, 349

(56) References Cited

U.S. PATENT DOCUMENTS 4,936,053 A * 6/1990 Shanelec ..... 451/224
5,549,508 A * 8/1996 Searle et al. ..... 451/141
5,725,415 A * 3/1998 Bernhard ..... 451/45
6,039,642 A 3/2000 Collins
6,123,611 A * 9/2000 Lawrence, Jr. ..... 451/361

* cited by examiner

*Primary Examiner*—Dung Van Nguyen
(74) *Attorney, Agent, or Firm*—Lanier Ford Shaver & Payne P.C.

(57) ABSTRACT

A method and apparatus for the sharpening of blades, particularly the blades of a lawnmower are provided. In the present invention, a blade sharpening apparatus with a supporting base comprises a blade retention and positioning mechanism, a blade sharpening mechanism and a guide rod for directing the blade sharpening mechanism laterally across the width of the apparatus. In a preferred embodiment of the present invention, the blade retention and positioning mechanism includes a hand operated crank for rotating the blade support means. Rotation of the blade support means allows for the proper positioning of the blade with respect to the sharpening mechanism so as to generate the correct sharpening angle for the sharpening of the blade. In such embodiment, the sharpening mechanism may be a lightweight, portable grinder mounted onto a supporting plate for movement along and rotation about a guide rod mounted to said supporting base of the apparatus.

19 Claims, 4 Drawing Sheets

APPARATUS AND METHOD FOR SHARPENING BLADES AT A PREDETERMINED ANGLE

BACKGROUND OF THE INVENTION

This invention generally relates to a blade sharpening apparatus. In particular, the present invention relates to an apparatus for the sharpening of lawnmower blades. More particularly, the present invention relates to a method and apparatus for the sharpening of lawnmower blades using a mobile longitudinal sharpener.

To optimize cutting performance, blades that are regularly used must be sharpened often. Sharpening the blades during manufacturing is typically performed using powered abrasive belts or wheels and with special fixtures which present the blade at the correct angle for sharpening. Accordingly, when the user purchases the blade, it is sharp and ready for use.

As the blade is put to use and encounters abrasive surfaces or hardened surfaces during its use, the blades may begin to dull, thus reducing its cutting effectiveness. This requires the user to sharpen the blade to restore its cutting edge. In the case of lawnmower blades, use of a dull blade can result in a tearing of the blades of grass. This damages the grass and can increase the grass' susceptibility to disease and decreases its aesthetic appearance.

Further still, the user may forego sharpening the blade and settle on using a dull blade. Sharpening of the blade can be a time consuming process. As a result, sharpening of the blade may be neglected by the user because of their lack of adequate tooling or an inability to properly sharpen the blade. Accordingly, once the blade has been put into service and becomes dull, it is often times not re-sharpened.

It is, therefore, desirable to provide an apparatus for the sharpening of blades that is simple to use. Further, it is desirable to provide an apparatus that allows for easy adjustment and retention of the blade at the optimum angle thus ensuring the proper relationship between the sharpening media and the blade. Further still, it is desirable to provide an apparatus that only allows limited movement of the sharpening media in relation to the blade, so as to ensure simplicity in the sharpening of the blade.

SUMMARY OF THE INVENTION

The present invention recognizes and addresses various of the foregoing limitations and drawbacks, and others, concerning apparatus for the sharpening of blades and in particular sharpening lawnmower blades with twin opposing cutting edges at either end of the blade. Therefore, the present invention is directed to a method and apparatus for the sharpening of lawnmower blades using a mobile longitudinal sharpener.

It is, therefore, a principle object of the subject invention to provide an apparatus that provides a simplified method for sharpening blades. More particularly, it is an object of the present invention to provide such an apparatus that allows for maintaining the sharpening means at the proper angle to generate a cutting edge on the blade at a desired angle. In such context, it is still a more particular object of the present invention to provide such an apparatus that allows for the maintenance of the blade in a stationary position while moving the sharpening means across the blade.

Still further, it is a principle object of this invention to provide an apparatus that provides an adjustable blade holding mechanism to permit the error proof positioning of the blade prior to sharpening. It is a further object of the present invention to provide a portable apparatus for use anywhere sufficient electrical power is available. In such context, it is an object of the present invention to provide a cost-effective apparatus that is manufactured of easily obtainable component parts.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description).

These and other features, aspects and advantages of the present invention will become better understood with reference to the following descriptions and appended claims. The accompanying drawings, which are incorporated in and constitute a part of this specification, illustrate an embodiment of the invention and, together with the descriptions, serve to explain the principles of the invention.

In one exemplary embodiment, there may be provided an apparatus for sharpening the blades at the proper angle comprising a base for mounting such an apparatus in a fixed location while providing adequate stability for the device. Such apparatus further comprises a blade retaining and positioning mechanism that may be adjusted by hand to rotate the blade into proper alignment for sharpening. Finally, such apparatus may comprise a sharpening mechanism including a portable grinder mounted on a supporting plate capable of lateral movement along a guide rod spanning the width of the apparatus. The support plate may additionally be capable of rotation about said guide rod for engagement with the blade at the appropriate angle and longitudinal adjustment to ensure adequate engagement of the blade surface by the grinder wheel.

The present invention includes a method of use which includes the steps of: first, mounting a blade to be sharpened in a blade retaining and positioning mechanism; second, adjusting such blade retaining and positioning mechanism and the longitudinal blade sharpening mechanism positioning means such that the blade sharpening mechanism engages the blade at the proper angle and with adequate contact for proper sharpening; third, engaging said blade sharpening mechanism with the blade to provide a properly sharpened edge; and fourth, where said blade has opposing edge blades, rotating said blade within said retaining and positioning means and repeating the second and third steps.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
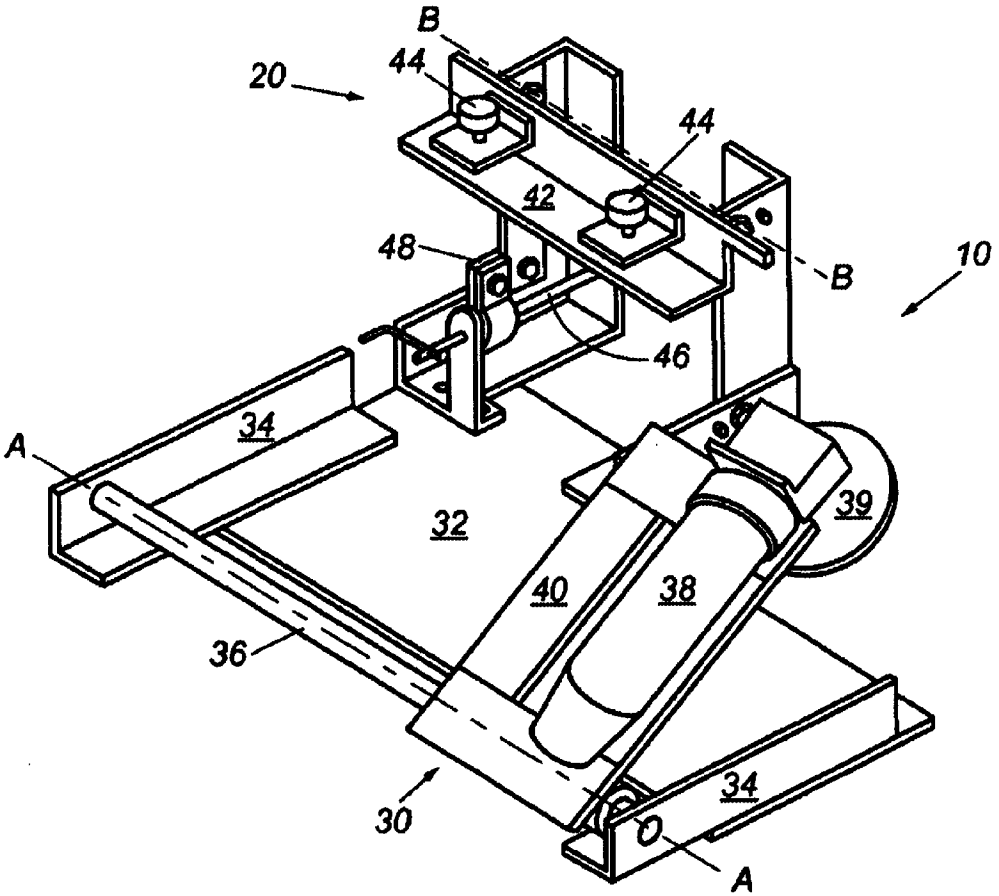
FIG. 1 is a perspective view of a first embodiment of the present invention.
Figure 2:
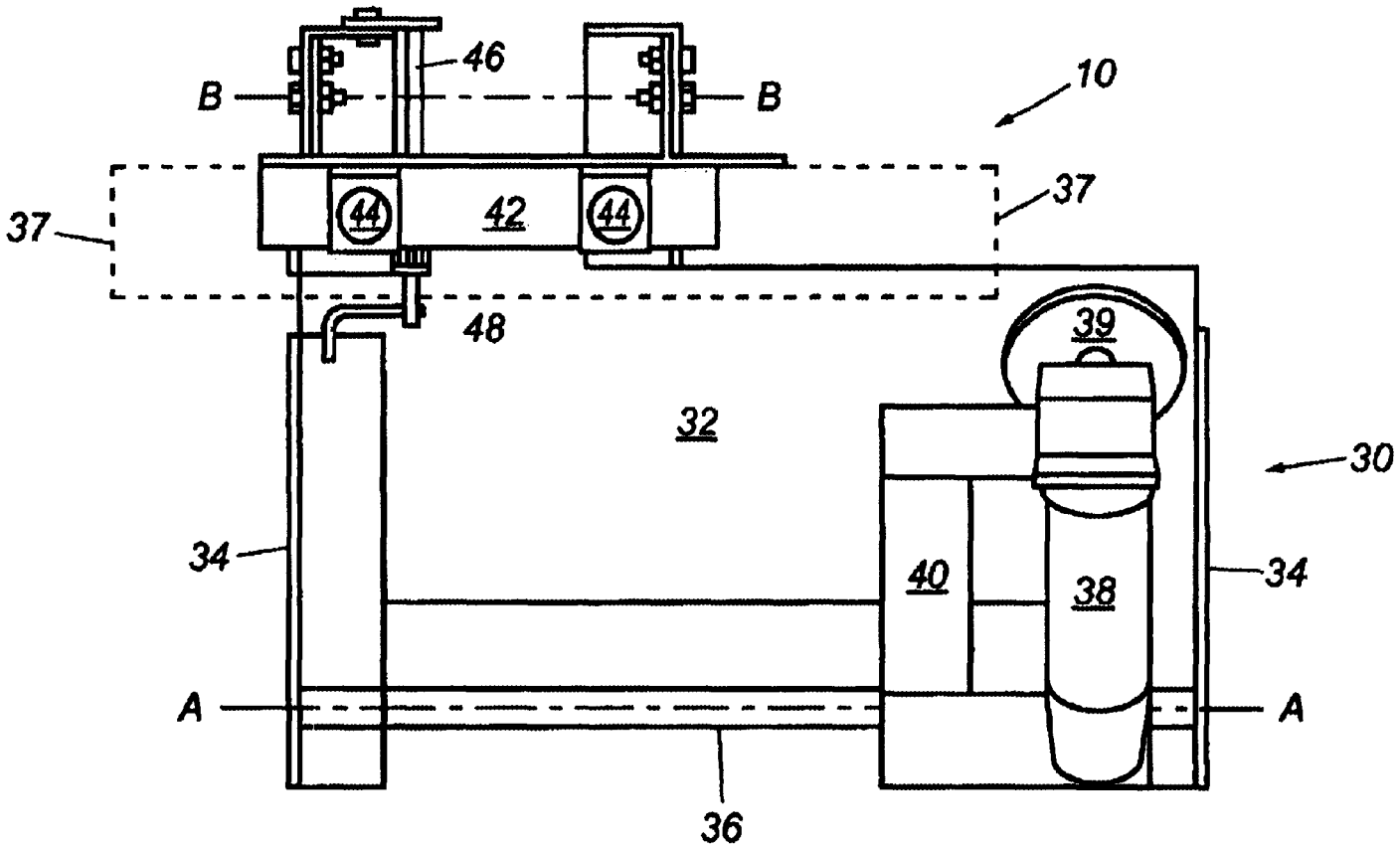
FIG. 2 is an orthogonal top view of the embodiment of the present invention shown in FIG. 1.

Repeat use of reference characters throughout the present specification and appended drawings is intended to represent the same or analogous features or elements of the invention.

DETAILED DESCRIPTION OF THE PREFERRED EMBODIMENTS

Reference will now be made in detail to presently preferred embodiments of the invention, examples of which are fully represented in the accompanying drawings. Such examples are provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

As disclosed above, the present invention is particularly concerned with a method and apparatus for sharpening blades, and in particular, the sharpening of lawnmower blades. As depicted in FIGS. 1–4, one exemplary embodiment of the present invention 10 may be provided that encompasses two primary components: first, a blade retaining and positioning mechanism 20 and second, a blade sharpening mechanism 30. Together these components may be operated within the boundaries of the present invention to properly position the blade and the blade sharpening means 30 relative to each other to ensure the correct angle is given to the edge of the blade during sharpening.

The present invention may be comprised of a base plate 32 of a size sufficient to provide adequate stability to the apparatus 10 but light enough to allow for portability. Additionally, the base plate 32 may be used to secure the apparatus 10 in a fixed position or to clamp the apparatus 10 in place during its use in the field, such as but not limited to a truck bed or a large work surface. Along each side of the generally rectangular base plate 32, support brackets 34 may be included to maintain a guide rod 36. A first end of the support brackets 34 and the guide rod 36 extend forward of the front edge of the base plate 32 to ensure adequate clearance between the two and to ensure no interference with the freedom of movement of the blade sharpening means 30 attached to the guide rod 36.

The blade sharpening means 30 may comprise any of the known devices for the sharpening of metal objects including files, grinders, and other abrasive devices. In the preferred embodiment of the present invention, a portable hand-held grinder 38 may be used. While the grinder 38 may be of any size, it has been found that a grinder of between about 3 and about 6 inches, preferably, about 4 inches, is sufficient to efficiently and safely sharpen most lawnmower blades. Such blade sharpening means 30 may further comprise a support plate 40 to which the grinder 38 is removably affixed, such as through the use of binder clips. The support plate 40 may be moved both rotationally about the longitudinal axis A-A of the guide rod 36 and laterally along the guide rod 36 for positioning relative to the blade requiring sharpening.

Figure 3:
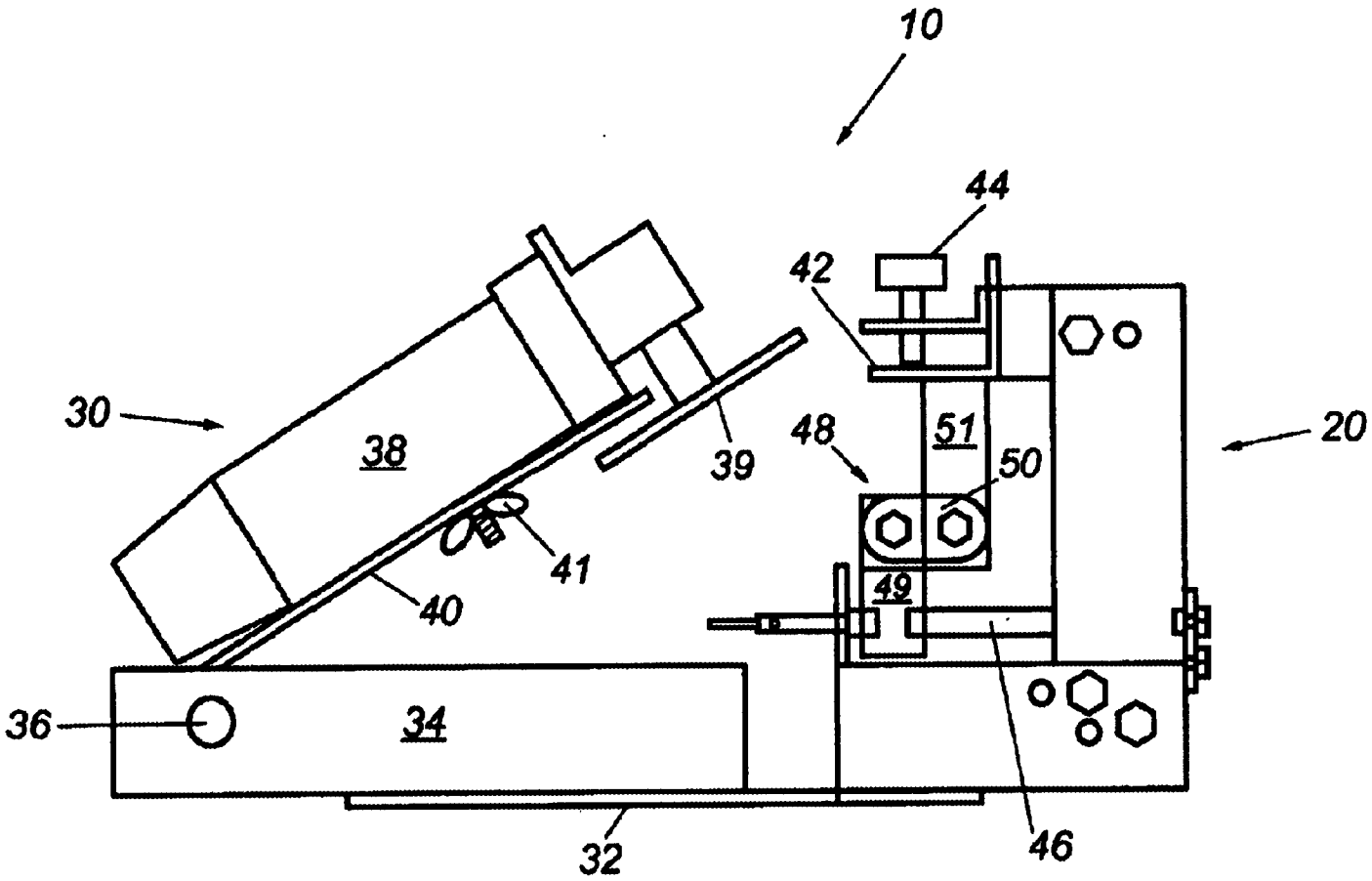
FIG. 3 is an orthogonal side view of the embodiment of the present invention as depicted in FIG. 1.
Figure 4:
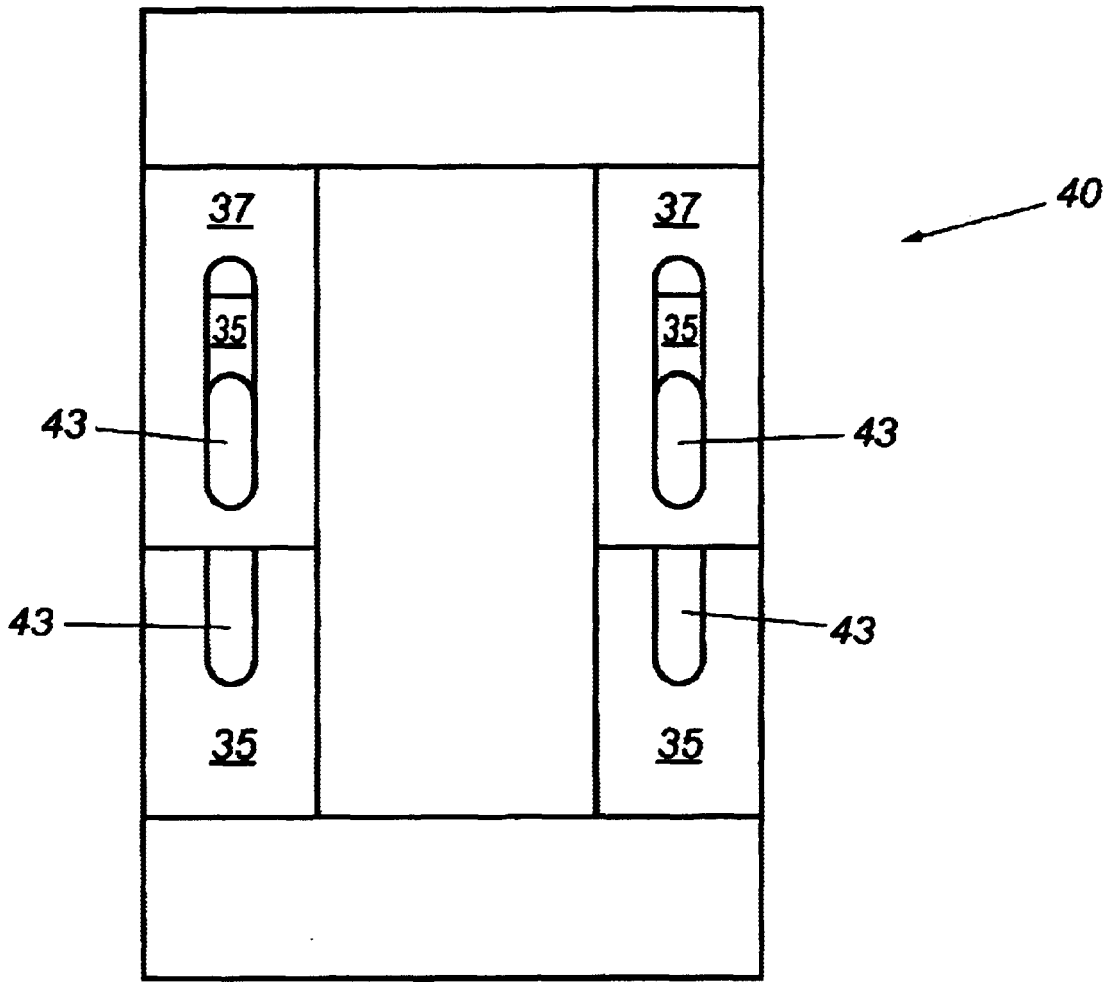
FIG. 4 is a top view of an embodiment of the longitudinally adjustable support plate for the blade sharpening means.

Further, as best seen in FIG. 4, the blade sharpening means' support plate 40 may be designed such that it is longitudinally adjustable to ensure the proper interaction with the outer portion 39 of such grinder 38 with the blade edge to be sharpened. Such adjustment may be achieved by any method capable of ensuring adequate support for such grinder 38 during its operation. In a preferred embodiment, the support plate 40 may comprise a pair of opposed halves 35 and 37. The longitudinal segments of each half 35 and 37 of the support plate 40 may be provided with slots 43 therein and overlap each other such that the slots 43 coincided. A pair of threaded bolts with wing nuts 41 (as best seen in profile in FIG. 3) may be provided to frictionally maintain the halves 35 and 37 of the support plate 40 in relative position once they have been adjusted as desired by the apparatus' user.

Alternatively, the support plate 40 may be a unitary piece structure that provides for a slot in one of the longitudinal segments for receipt of a longitudinal positioning guide mounted to or an integral part of the grinder 38 itself. In such an embodiment the additional longitudinal segment of the support plate 40 would function primarily to add strength to the support plate 40 (i.e., to avoid torque) and also as an easy handle for use in adjusting and steadying the grinder 38 prior to and during its use.

The blade retaining and positioning mechanism 20 may be connected to the rear of the base plate 32 using support brackets similar to those used to maintain the guide rod 36 and the blade sharpening mechanism 30 at the front of the apparatus 10. Such support brackets may be simple angled pieces of metal or other material or alternatively, may be a more specifically designed support element for use in this particular environment. All of the support brackets may be permanently affixed to the base plate 32 using any of the known methods of attachment, including, but not limited to the use of nuts and bolts, welds, screws, nails, rivets, adhesive or any combination thereof.

A second end of the blade retaining and positioning mechanism's support brackets may extend beyond the rear edge of the base plate 32. Rigidly attached to said second ends of each support bracket may be vertical support members. Rotationally affixed to such vertical support members is a blade mount 42 for receipt of the blade requiring sharpening. Such blade mount 42 may be comprised of a simple elongated piece of angled metal similar to the support brackets and vertical support members. Affixed to the rear of the blade mount 42 and extending over the horizontal portion thereof may be at least two blade retention means 44. The blade retention means 44 may be as simple as a screw which may be tightened to hold the blade in the blade mount 42 by friction. Other blade retention means 44 may be used, including, but not limited to clamps or the temporary affixation of the blade to the blade mount by way of the mounting hole at the center of all blades which is used to mount the blades on their respective lawnmowers.

As before mentioned and as best seen in FIGS. 1 and 3, the blade mount 42 is rotationally mounted to the vertical support members for rotation about longitudinal axis B-B. The object blade 37 may be mounted within the blade mount 42 and a hand-operated adjustable screw 46 may be rotated to reposition linkage 48 between such adjustable screw 46 and the blade mount 42. Linear movements of linkage 48 generate the rotational motion of the blade mount 42. The horizontal linear translation of first linakage member 49 drives the rotational translation of an intermediate linkage member 50 which in turn drives the vertical linear translation of last linkage member 51. Such vertical linear translation generates the desired rotational movement of the blade mount 42 (as best seen in FIG. 3).

When a blade is mounted in the apparatus 10 of the present invention, the hand-operated adjustable screw 46 may be used to alter the angle of the blade relative to the blade sharpening mechanism 30. Generally, this may be done by eye or by simply bringing the grinder 38 and 39 into contact with the blade while the grinder 38 and 39 is off and adjusting the blade angle so as to ensure complete contact with the grinder 38 and 39 at the blade's edge. The grinder 38 and 39 is then assured a generally flat surface upon which to rest during the sharpening process and the user may simply slide the sharpening mechanism 30 along the guide rod 36 to sharpen the blade properly. For blades with opposing end edges, the blade may be removed, rotated end-to-end, and remounted and automatically they should be presented to the grinder 38 and 39 at the proper angle. Such ease of establishing the proper angle for sharpening allows numerous blades to be sharpened in a relatively short period of time provided they all require the same angle for their blade edge.

Although a preferred embodiment of the invention has been described using specific terms and devices, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of various other embodiments may be interchanged both in whole or in part. Therefore, the spirit and scope of the appended claims should not be limited to the description of the preferred version contained herein.

What is claimed is:

1. A sharpener for a blade, comprising:

a base plate;

a first pair of support brackets, each of said first pair of support brackets having a first end extending forward of the front edge of said base plate;

a guide rod, said guide rod extending laterally between said first ends of said first pair of support brackets;

a blade sharpening mechanism;

a second pair of support brackets, each of said second pair of support brackets having a second end extending rearward of the back edge of said base plate;

a pair of vertical support members, each of said support members attached to a corresponding one of said second ends of said second pair of support brackets;

a blade mount rotationally attached at each end to one of said pair of vertical support members, wherein said blade mount further comprises at least two blade retaining members;

a hand-operated adjustable screw mechanism; and a linkage connecting said blade mount and said hand-operated adjustable screw mechanism.

2. A sharpener for a blade as in claim 1, wherein said blade is a lawnmower blade.

3. A sharpener for a blade as in claim 1, wherein said blade sharpening mechanism comprises a grinder.

4. A sharpener for a blade as in claim 3, wherein said grinder is removably mounted to a support plate and wherein said support plate is permanently mounted for both rotation about and lateral movement along said guide rod, and wherein said support plate is capable of longitudinal adjustment so as to ensure proper interaction of said grinder with an edge of said blade.

5. A sharpener for a blade as in claim 1, wherein said linkage comprises a first, an intermediate, and a last linkage member, and wherein rotation of said screw mechanism causes a corresponding rotation of said blade mount by way of the translation of said intermediate linkage member along the length of said screw mechanism.

6. A blade sharpening apparatus, comprising:

a support frame further comprising a base plate, a first pair of supporting brackets, a second pair of supporting brackets and a pair of vertical support members;

a blade maintaining and positioning mechanism; and a blade sharpening mechanism.

7. A blade sharpening apparatus as in claim 6, wherein said first pair of supporting brackets have a first end and wherein said first end of said first pair of supporting brackets extend forward of the front of said base plate.

8. A blade sharpening apparatus as in claim 7, wherein a guide rod extends between said first ends of said first pair of support brackets.

9. A blade sharpening apparatus as in claim 6, wherein said second pair of supporting brackets have a second end and wherein said second end of said second pair of supporting brackets extend rearward from the back of said base plate.

10. A blade sharpening apparatus as in claim 9, wherein each of said pair of vertical support members is permanently affixed to a respective one of said second pair of supporting brackets.

11. A blade sharpening apparatus as in claim 10, wherein said blade maintaining and positioning mechanism has a first and a second end and wherein said first and second ends of said blade maintaining and positioning mechanism is rotatably attached to a corresponding one of said vertical support members.

12. A blade sharpening apparatus as in claim 11, wherein said blade maintaining and positioning mechanism is manually rotated by way of a linkage connected to a hand-operated adjustable screw mechanism.

13. A blade sharpening apparatus as in claim 6, wherein said blade sharpening mechanism comprises a grinder.

14. A blade sharpening apparatus as in claim 13, wherein said grinder is removably affixed to a support plate, and wherein said support plate is permanently attached to a guide rod spanning the width of said support frame, said support plate being capable of both rotational and lateral movement about or on said guide rod, respectively, and wherein said support plate is capable of longitudinal adjustment to ensure proper interaction of said grinder with an edge of said blade.

15. A method for sharpening blades, comprising the steps of:

a) removably mounting a blade in a blade sharpening apparatus;

b) positioning the blade at the proper angle for sharpening; and c) sharpening said blade by engaging a blade sharpening mechanism of said apparatus, wherein said blade sharpening apparatus comprises a support frame further comprising a base plate, a first pair of supporting brackets, a second pair of supporting brackets and a pair of vertical support members, a blade maintaining and positioning mechanism, and a blade sharpening mechanism.

16. A method for sharpening blades as in claim 15, wherein said blade is removable mounted on a flat surface using at least two blade retaining members.

17. A method for sharpening blades as in claim 15, wherein said positioning step further comprises the steps of:

b1) aligning said blade sharpening mechanism with said mounted blade; and b2) rotating said flat surface until said blade and said blade-sharpening mechanism meet at the desired edge angle.

18. A method for sharpening blades as in claim 15, wherein said blade sharpening mechanism is a grinder moveably mounted in said blade sharpening apparatus.

19. A method for sharpening blades as in claim 18, wherein said grinder's longitudinal movement is restricted by a lateral guide rod.

* * * * *